US006158228A

United States Patent [19]

Nakamura et al.

[11] Patent Number: 6,158,228

[45] Date of Patent: Dec. 12, 2000

[54] METHOD AND APPARATUS FOR MANUFACTURING SINGLE CRYSTAL METHOD FOR CONTROLLING CRYSTAL ORIENTATION OF SINGLE CRYSTAL ICE

[75] Inventors: Ikuo Nakamura; Hiroshi Morimoto; Tetsuya Kokubo; Minoru Iwasaki; Toshihiro Kiuchi; Zenji Imamura; Syoji Okamoto, all of Osaka; Katsutoshi Tsushima, 146 Keyakidai, Teramachi, Toyama-shi, Toyama, 930-0875, all of Japan

[73] Assignees: The Kanden Kogyo, Inc.; The Kansai Electric Power Co., Inc., both of Osaka; Katsutoshi Tsushima, Toyama, all of Japan

[21] Appl. No.: 09/247,078

[22] Filed: Feb. 9, 1999

[30] Foreign Application Priority Data

Feb. 23, 1998 [JP] Japan ..... 10-039945

[51] Int. Cl.[7] ..... F25C 1/12

[52] U.S. Cl. ..... 62/74

[58] Field of Search ..... 62/74, 347

[56] References Cited

U.S. PATENT DOCUMENTS

| | | | |
|---|---|---|---|
| 2,491,837 | 12/1949 | Smith-Johannsen et al. | 62/74 |
| 3,052,557 | 9/1962 | Vidal et al. | 62/347 |
| 4,077,227 | 3/1978 | Larson | 62/74 |
| 4,715,194 | 12/1987 | Kito | 62/347 |
| 5,219,383 | 6/1993 | Minari et al. | 62/74 |
| 5,327,738 | 7/1994 | Morioka et al. | 62/74 |

*Primary Examiner*—William E. Tapolcal
*Attorney, Agent, or Firm*—Birch, Stewart, Kolasch & Birch, LLP

[57] ABSTRACT

A method for manufacturing single crystal ice by creating a temperature environment in which a top section of the refrigerating temperature distribution of a hermetically sealed refrigerating space is held to high temperature and a bottom section to low temperature, guiding water to the high-temperature section, and dripping droplets of the water to the low-temperature section.

2 Claims, 8 Drawing Sheets

Sketch of mobile blade(front view)

METHOD AND APPARATUS FOR MANUFACTURING SINGLE CRYSTAL METHOD FOR CONTROLLING CRYSTAL ORIENTATION OF SINGLE CRYSTAL ICE

BACKGROUND OF THE INVENTION

The present invention relates to a method for manufacturing single crystal; a method for manufacturing single crystal ice; a method for controlling crystal orientation of single crystal ice; an apparatus for manufacturing single crystal ice; a technique for making ice for a skate-rink using single crystal ice.

Hitherto, it has been known that single crystal ice grows naturally as ice-stalagmites in accord with conditions in limited places such as at the upper reaches of the Kurobe River system.

The single crystal ice has special characteristics in that it is of a single crystal, transparent, and difficult to melt, and these characteristics in mind, this invention intends to artificially make single crystal ice.

SUMMARY OF THE INVENTION

It is an object of this invention to develop an ice-making technique which can control crystal orientation as well as a single crystal substance through dripping of droplets of liquid substances other than water, by taking in water used for ice making through a conducting tube for artificially making single crystal ice, dripping by gravity droplets of water at the optimum water dropping amount and dropping intervals for achieving characteristics of single crystallinity, transparency, and difficulty to thaw with a water dropping apparatus in a hermetically sealed refrigerating space with temperature strictly controlled, and allowing ice lumps to grow above the ground surface in the form of a ice-stalagmite.

Accordingly, under the above-mentioned circumstances, this invention adopts a single crystal manufacturing method for manufacturing a single crystal substance for providing the single crystal substance by dripping by gravity droplets of a liquid substance from a high-temperature section to a low-temperature section in a hermetically sealed refrigerating space for creating a temperature environment with the upper section held to a high temperature and the bottom section to a low temperature.

This invention adopts a single crystal ice manufacturing method for manufacturing single crystal ice by creating a temperature environment with a top section thereof held to a high temperature and a bottom section thereof held to a low temperature in the refrigerating-temperature distribution in the hermetically sealed refrigerating space, conducting water to the high-temperature section, and dripping droplets of the water to the low-temperature section.

In addition, this invention adopts a single crystal ice manufacturing apparatus in order to provide a single crystal ice manufacturing apparatus by arranging cooling pipes at the bottom section in the hermetically sealed refrigerating space with the inner surface covered with heat insulating material, arranging a water conducting tube at the top section of the hermetically sealed refrigerating space, connecting the dripping apparatus to the water conducting tube, creating a temperature environment in which the top section of the refrigerating temperature distribution is held to high temperature and the bottom section to low temperature in the hermetically sealed refrigerating space, dripping water droplets from the dripping apparatus, and making single crystal ice at the bottom section.

Furthermore, this invention adopts a crystal orientation control technique in order to control the crystal orientation of single crystal ice by extracting seed ice from single crystal ice already brought up, installing it to the ice brought up from the bottom section of the single crystal ice manufacturing apparatus, and supplying water from the top section to that portion to allow single crystal ice to grow.

This invention adopts a skate-rink ice-making technique in order to provide a high-speed skate rink with less frictional resistance by cutting the single crystal ice in the same crystal orientation of the face crossing the crystal orientation at right angles, and affixing the ice to the skate rink to make ice.

DETAILED DESCRIPTION OF THE PREFERRED EMBODIMENTS

Figure 1:
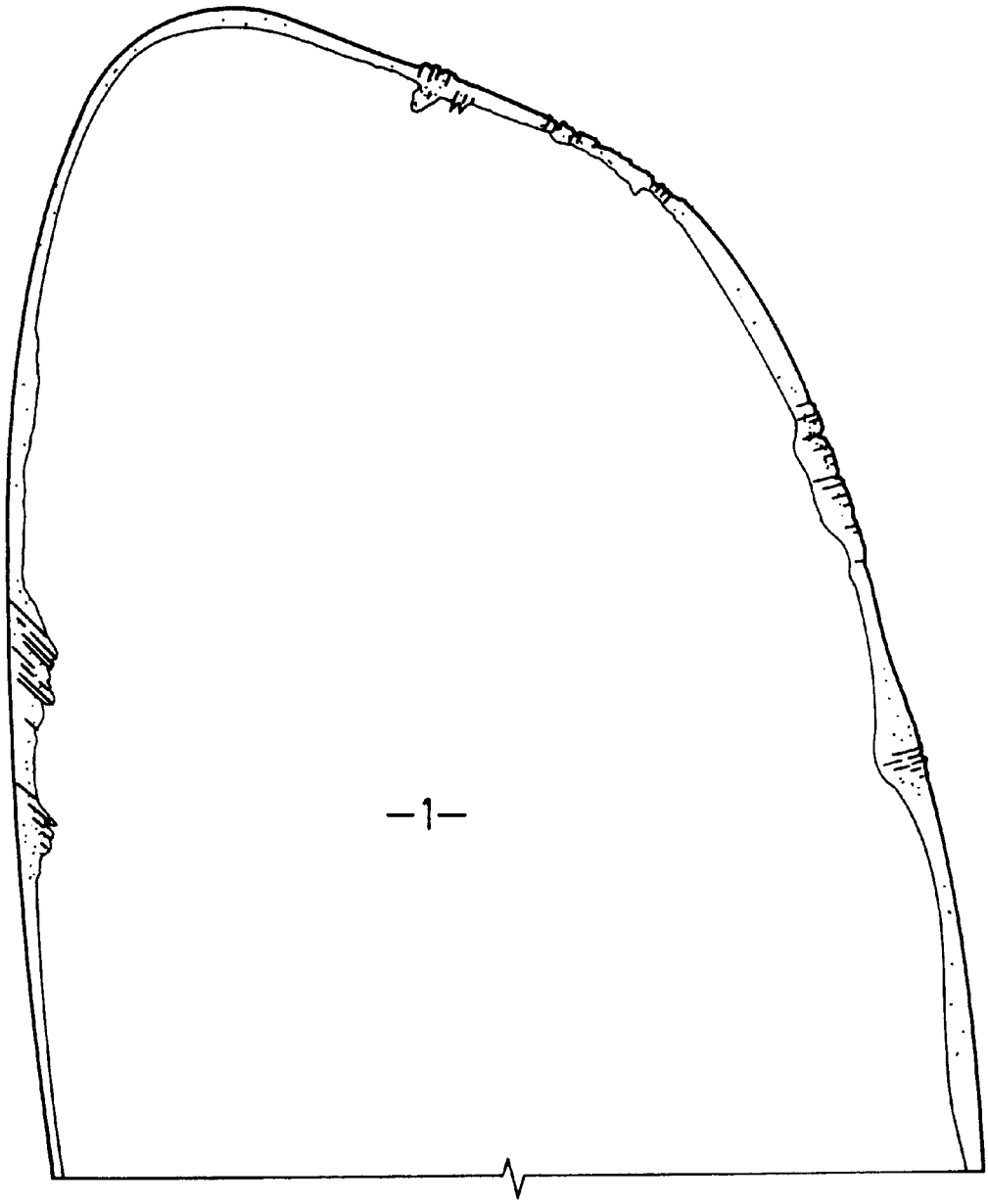
FIG. 1 is a longitudinal cross sectional view of ice-stalagmite comprising single crystals.

Referring now to the drawings, preferred embodiments according to the invention will be described in detail hereinafter.

Figure 2:
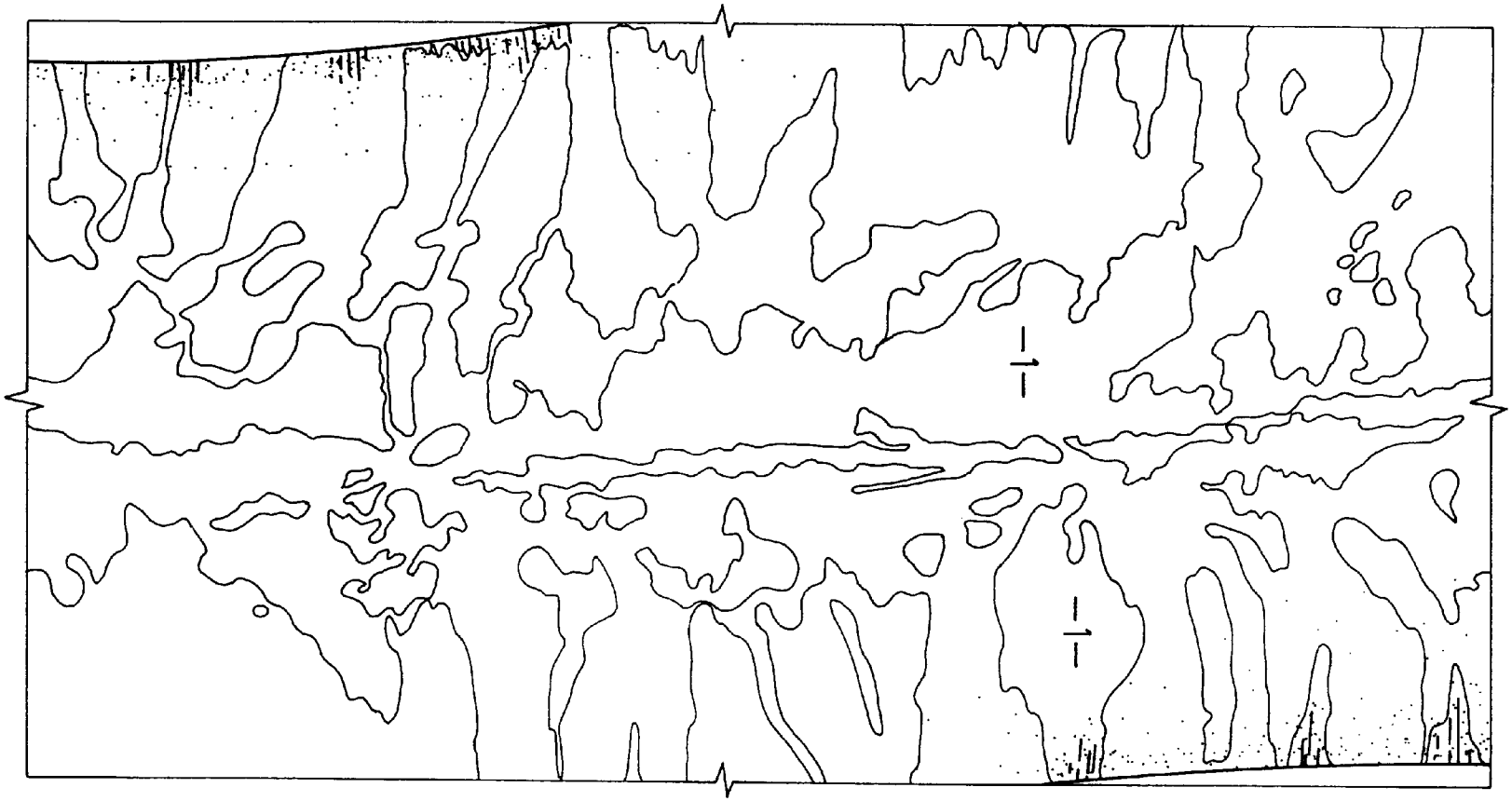
FIG. 2 is a longitudinal cross sectional view showing the condition in which a large number of single crystals get together.

First of all, FIG. 1 and FIG. 2 show single crystal ice and polycrystal ice. In FIG. 1, ice comprising a single crystal 1 is shown, while in FIG. 2, a condition in which a large number of single crystals 1 gather is shown.

Figure 3:
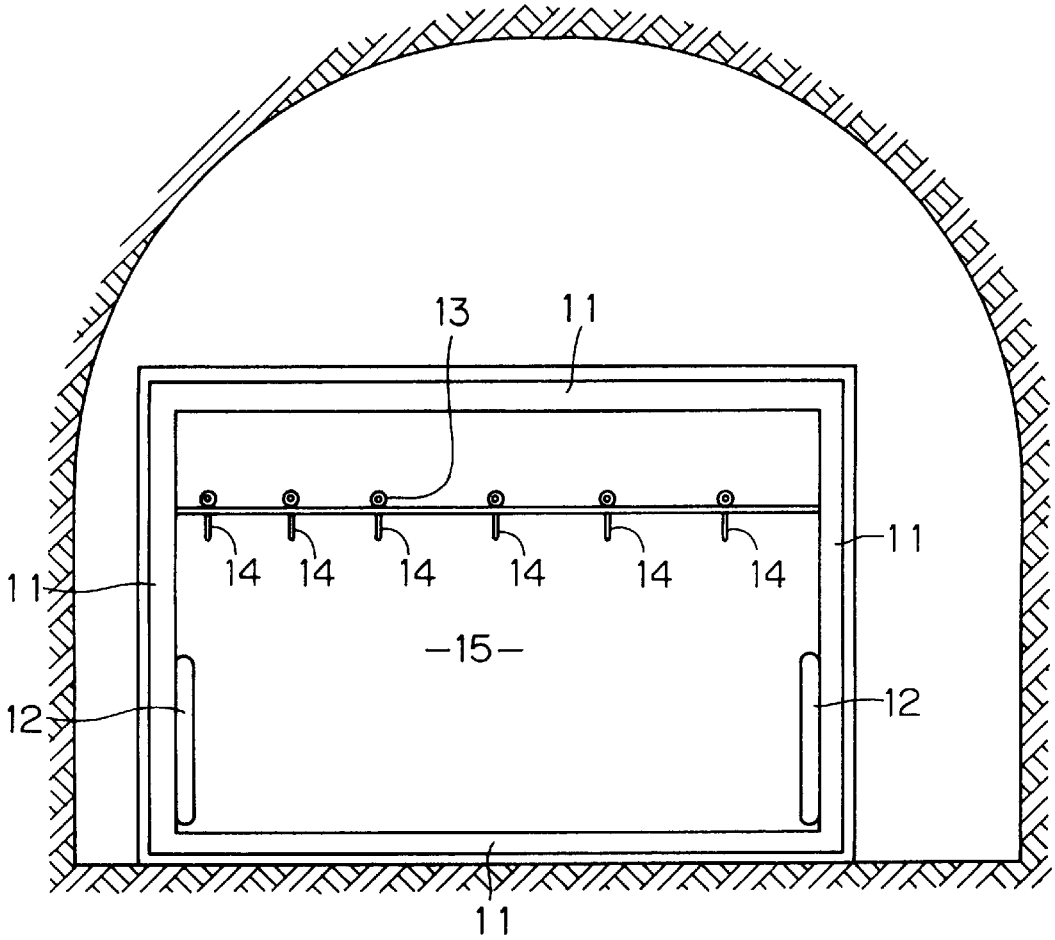
FIG. 3 is a longitudinal cross sectional view of an artificial ice-stalagmite manufacturing apparatus.

FIG. 3 shows an ice-making apparatus for artificially manufacturing single crystal ice.

The artificial manufacturing apparatus is a refrigerating apparatus that can artificially create an environment for bringing up natural ice-stalagmites. In a constant temperature location such as an underground space, etc. where temperature conditions are comparatively stable, a hermetically sealed refrigerating space 15 with the inner surface covered with heat insulating material 11 is formed, to the bottom section of the hermetically sealed refrigerating space 15, cooling pipes 12 are arranged, to the top section of the hermetically sealed refrigerating space 15, water conducting pipe is arranged, to the water conducting tube 13, water droplet dripping apparatus 14 are connected, a temperature environment in which the top section of the refrigerating temperature distribution of the hermetically sealed refrigerating space 15 is held to high temperature and the bottom section to low temperature is created, from dripping apparatus 14, water is dripped, and single crystal ice is manufactured.

Figure 4:
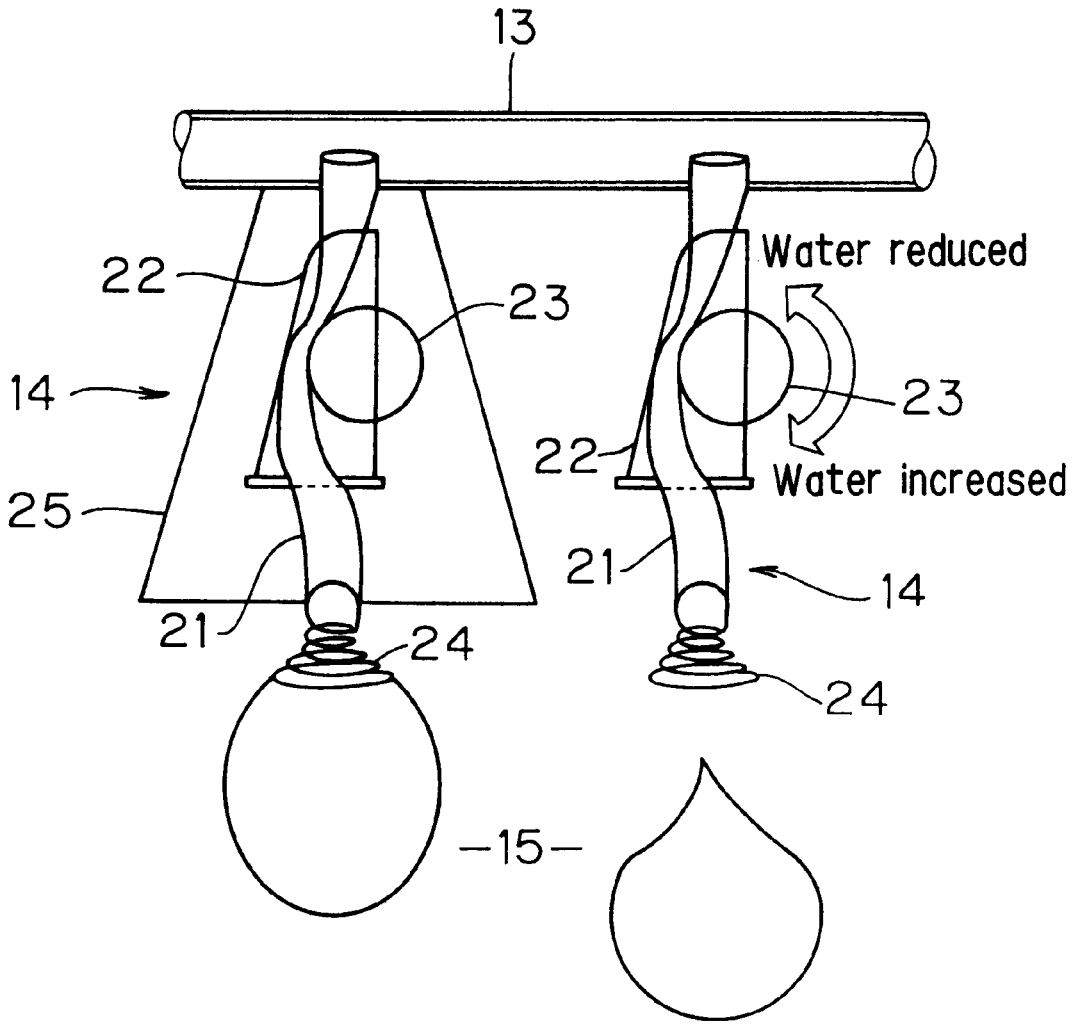
FIG. 4 is a drawing for explaining a drip dropping apparatus.

FIG. 4 shows the details of the dripping apparatus 14. The dripping apparatus 14 is trailingly connected to the water conducting tube 13, the polyethylene drip tube 21 decreases the water amount as it goes upwards by a roller 23 which is guided by the frame member 22 to make vertical movements, stops dripping of water at the top end, and increases the water amount as it goes downwards. To the bottom end of the polyethylene drip tube 21, spiral wire 24 is fitted in order to increase the capacity per one drop of water dripped.

A cap 25 for covering the drip polyethylene tube 21 prevents water inside the polyethylene drip tube 21 from freezing.

At the water conducting tube 13, water at about +4° C. is circulated, while the cooling tube 12 brings the water down to about −10° C. Under this condition, by hot air of the water conducting tube 13 and cold air of the cooling tube 12, a temperature environment with the top section of the temperature distribution in the hermetically sealed refrigerating space 15 held to a high temperature and the bottom section to a low temperature is created, and water is dripped from the dripping apparatus 14 to the environment, and single crystal ice is made at the bottom section.

Artificial ice manufacturing method:

1. Water temperature control of circulating water

When the circulating water temperature is excessively high, water is unable to make ice even when water drips drops, and when the circulating water temperature is excessively low, the water drip does not drop and freezes cold. Therefore, circulating water temperature must be controlled, and in this invention, it has been determined that the inflow water temperature is preferably about 4° C.±1° C.

In order to practice this temperature control, inflow water is stored temporarily in a water reservoir, heaters and coolers for water temperature adjustment are installed, and temperature control was carried out for the circulating water. In this invention, because well-water inside the tunnel was used, water temperature was stable nearly at around 4° C., and no adjustment was required.

2. Temperature control of hermetically sealed refrigerating space

For temperature of the hermetically sealed refrigerating space 15, when it is excessively cooled, dropping water instantaneously freezes on the ice surface already brought up, each fabricates crystal grain, and it becomes difficult to make single crystal ice. In the water dripping position at the top, water drop-freeze and do not drop. On the other hand, when the temperature is high, water drops do not freeze, and ice is unable to be fabricated. Consequently, the water drip temperature, top temperature in the hermetically sealed refrigerating space 15, and temperature at the place where water drip lands become important elements.

The temperature of the hermetically refrigerating space 15 is preferably −3° C.±1° C. at the bottom section and nearly 0° C. in the vicinity of the water conducting tube 13 where the top section circulating water passes, and the temperature in the hermetically sealed refrigerating space 15 is adjusted by installing a sensor to the bottom and using a thermostat to achieve the set temperature. Because the refrigerating facilities result in degrading the refrigerating capacity by frost adhering during cooling, standby piping was installed with care to prevent temperature inside the hermetically sealed refrigerating space 15 from rising even during defrosting.

3. Adjustment of water dripping intervals (time)

When the water dripping intervals are excessively short, the water does not freeze at the location where it lands and does not form an ice-stalagmite. When it is excessively long, water instantaneously dries and fabricates polycrystal ice or makes ice with air bubbles entrapped in it, and ice growth is slow.

If water drips are no longer supplied after part of ice grows, the ice pillar itself is excessively cooled and even when water drips are supplied next, there is a high possibility in that new crystal grains are formed. Based on these, it is preferable to supply water drips continuously and as long as possible, and the water drip amount must be increased in accord with the degree of ice-stalagmite growth. The increase of water drips was adjusted by shortening the dripping intervals.

It has been identified optimum that the dropping intervals at site is about 20–30 seconds/drop until ice is formed and about 8–15 seconds/drop when the ice-stalagmite grows to a certain extent (about 15 cm). When the dropping intervals are excessively shortened, the top section melts and forms a hole, and when it is excessively extended, a large number of water drips freeze at the water dripping position of the top section.

The appropriateness of adjusting the dripping intervals may be judged by the form of ice produced, and if ice in the form of a tea caddy is produced, the dropping intervals must be shortened. In the same manner, if ice with air bubbles entrapped is produced, the dripping intervals must be shortened. On the other hand, if holes or recesses are observed at the water dropping position, the dripping intervals must be extended.

4. Adjustment of water drip size:

The size of the water drip is increased with the spiral wire 24, but it is assumed to be more effective to increase the water drop size as ice grows. This is necessary to increase the diameter of ice pillar for water drips to drop and spread to the vicinity of the ice pillar. Ideally, water must reach the root of the ice pillar, and it has been identified that it is preferable to vary the water drip size in accord with the degree of growth of ice pillar.

5. Quality and installation of floor ice

Floor ice is necessary for enabling rapid growth of ice-stalagmites, and has two objects for installation.

① By covering the floor with ice, cold air of the hermetically sealed refrigerating space 15 is prevented from escaping from the floor.

② By installing a semi-circular shape ice, water drips dropping from the top section are allowed to freeze easily and growth of ice-stalagmites is promoted.

The floor ice is installed for these purposes, but it takes quite troublesome to freeze the floor of Paragraph ②, and in this invention, a thin coat of water is spread over the whole floor to form the floor ice.

Thereafter, the head portion of the once fabricated ice-stalagmite was left, and by laying this at the water dripping position, the object of Paragraph ② can be achieved. The ice of ice-stalagmites has a high possibility to have formed a single crystal and can be also used as seed ice.

6. Crystal orientation control technique of single crystal ice

The seed ice is installed to adjust the crystal orientation of ice bamboo shoots, and is required where the crystal orientation must be aligned as in the case of installing ice in a skate-rink.

The seed ice is not necessary to be installed for ice whose crystal orientation is not aligned (for example, ice in whisky on the rocks, ice-pillar flower, etc.).

Since there is a case in which a single crystal is not formed on the top section of the seed ice placed, the seed ice must be installed with care placed to the following.

Reasons why single crystal ice does not grow from seed ice:

① When seed ice which is cooled to below zero and which has crystal of foreign matter generated on the surface layer is installed.

When the surface thin layer is changed in the process of cutting out and moving the seed ice (when the surface is melted and recrystalized, or when water freezes to form a thin layer) and other crystal exists, the crystal surface of the seed ice is not exposed and single crystal ice is unable to grow.

② When the crystal surface of the seed ice is exposed but the seed ice is cooled to below zero and then the first water drops drip.

In this case, the water drip colliding against the seed ice instantaneously freezes while spreading thinly and forms foreign matter crystal grains.

To solve the above two problems ① and ②,

The base ice-stalagmite to which seed ice is installed and ice seed must be thoroughly wetted and installed, and a hot plate (smooth metal plate warmed with hot water) is pressed against the surface of seed ice installed and the seed ice surface is melted to be smooth. However, water drips must be continuously dropped as usual during this period. When the seed ice area is large, the peripheral portion should be further melted to remove sharp corners.

This is to allow water drips to easily flow so that it spreads to the root of ice-stalagmites.

Figure 5:
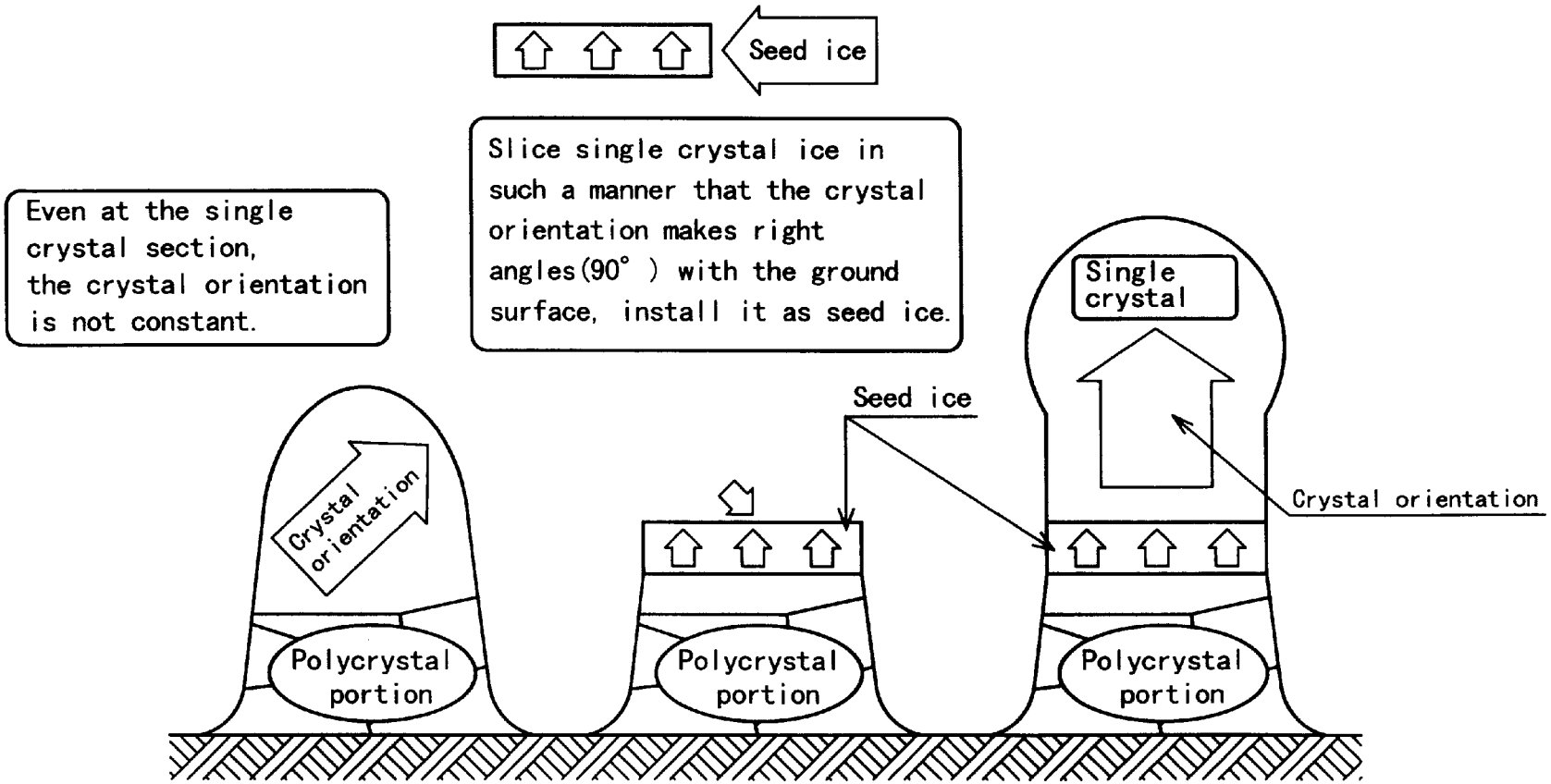
FIG. 5 is a drawing for explaining the control of crystal orientation of ice bamboo shoot.

FIG. 5 is an illustration of crystal orientation. The figure on the left shows that the single crystal ice is formed with one crystal but shows all orientations (upwards, sideways, oblique). The figure at the center shows the condition in which seed ice cut at the plane crossing with crystal orientation at right angles is installed to be parallel with the ground surface, and the figure on the right shows the condition in which the single crystal ice grows in the direction same as crystal orientation of the seed ice.

The seed ice is obtained by removing polycrystal portions of the artificially formed ice-stalagmites, checking the crystal orientation, and slicing it about 7 mm thick. When water is supplied to the seed ice, single crystal grows vertically as shown in the figure on the right.

7. Skate-rink ice making technique using single crystal ice

Figure 8:
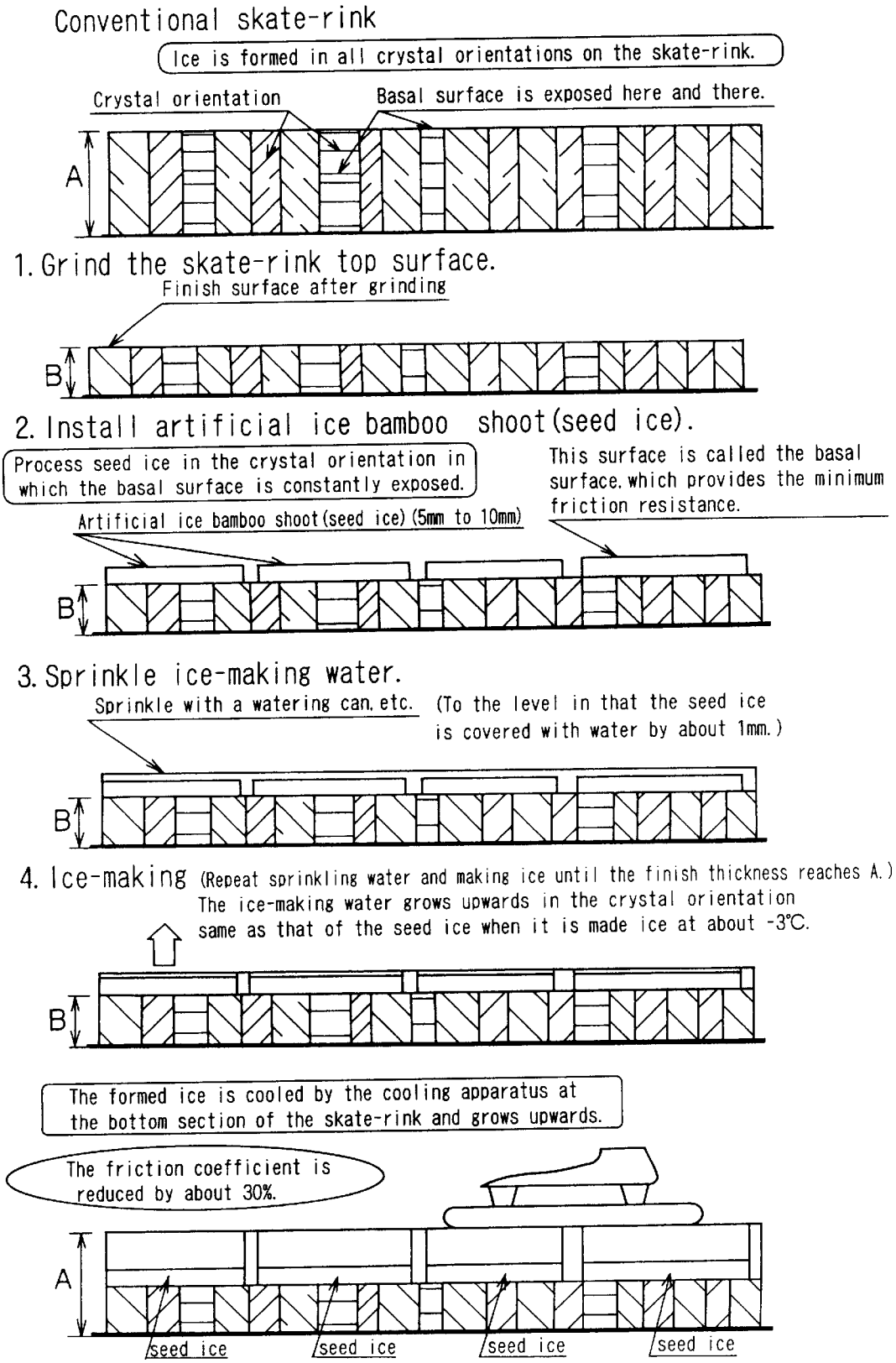
FIG. 8 is a drawing for showing the skate-rink ice-making technique (ice-making procedure).

Referring now to FIG. 8, the skate-rink ice making technique (ice making procedure) will be described.

In the conventional skate rink, as illustrated, ice is formed in all crystal orientations. Because ice is formed in all crystal orientations, the basal surface which crosses with the crystal orientation at right angles and provides the minimum friction coefficient appears here and there. Let this conventional skate-rink ice thickness be A. Then, grind the top surface of the conventional skate-rink whose ice thickness was A until the ice thickness becomes B. Finish the top surface after grinding.

Then, affix the artificial ice-stalagmite (seed ice). In order to minimize the friction coefficient, process seed ice in the crystal orientation in which the basal surface is constantly exposed. Keep the thickness of artificial ice-stalagmite (seed ice) to 5 mm to 10 mm.

Thereafter, sprinkle ice-making water with a watering can, etc. so that the seed ice is covered with water by about 1 mm.

The ice-making water grows upwards in the crystal orientation same as that of the seed ice when it is made ice at about −3° C. Repeat sprinkling water and making ice until the finish thickness reaches A previously mentioned.

The formed ice is cooled by the cooling apparatus at the bottom section of the skate-rink and grows upwards.

The skate-rink formed in this way has the friction coefficient reduced by about 30%. In a certain skate rink, using existing high-quality skate-rink ice and ice-stalagmite installed rink in which ice-stalagmite according to this invention was cut at the plane crossing with the crystal orientation at right angles, friction coefficient measurements and test runs were carried out.

The results indicate as shown below that the friction coefficient can be reduced by 22%, and a high-speed skate-rink can be achieved. Results of validation tests (friction coefficient measurement test and test-runs):

Outline of the friction coefficient measurement test:

The friction coefficient measurements were carried out a total of 10 times, that is, 5 times each in traveling direction and 5 times each in reverse traveling direction on the artificial ice-stalagmite ice surface and general surface (20 times in total).

Figure 6:
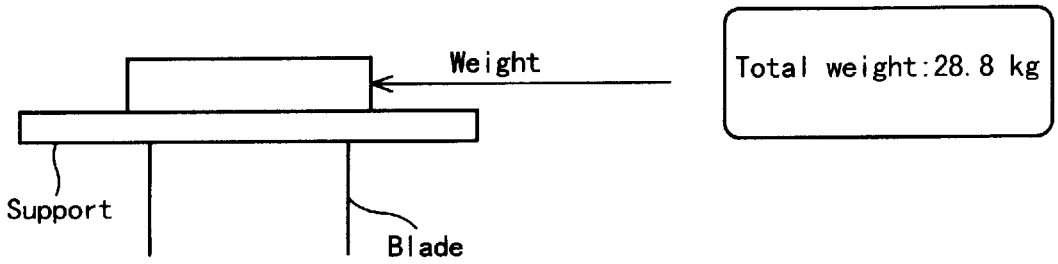
FIG. 6 is a front view showing the outline of the mobile blade.

For the measuring method, a mobile blade (28.8 kg) shown in FIG. 6 was shot from a catapult, and the passing time between speed measuring markers (2 m) was measured with video cameras. The traveling distance was measured from the center of the speed measuring section. Each catapult and measuring method were those adopted by Sapporo Winter Olympics.

Figure 7:
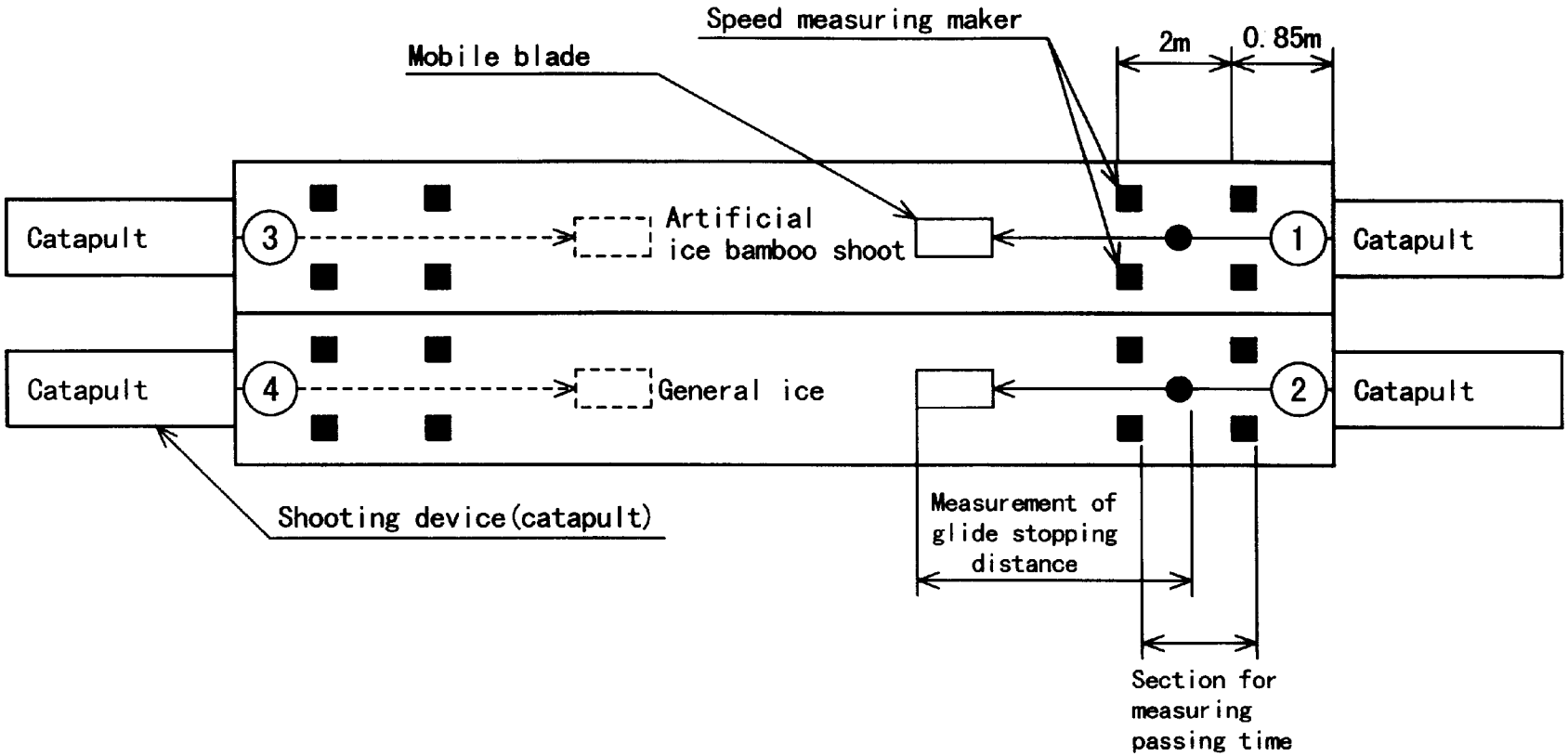
FIG. 7 is a drawing explaining the frictional coefficient measuring method.

FIG. 7 shows the measuring method (figures in circles indicate the measuring order).

Measurement results of friction coefficient:

TABLE 1

| | Traveling direction | | | Reverse traveling direction | | | |
|---|---|---|---|---|---|---|---|
| Times | Gliding stop distance | Passing time | Friction coefficient | Gliding stop distance | Passing time | Friction coefficient | Test results |
| Test on general ice | | | | | | | |
| 1 | 5.96 m | 2.16 s | 0.0073 | 5.62 m | 2.05 s | 0.0086 | Mean friction |
| 2 | 5.42 m | 2.11 s | 0.0085 | 5.81 m | 1.96 s | 0.0071 | coefficient |
| 3 | 5.73 m | 2.12 s | 0.0079 | 5.83 m | 1.96 s | 0.0091 | 0.0082 |
| 4 | 5.20 m | 2.21 s | 0.0080 | 5.98 m | 2.00 s | 0.0085 | |
| 5 | 5.94 m | 2.16 s | 0.0074 | 5.60 m | 2.01 s | 0.0090 | |
| Mean | | | 0.0078 | | | 0.0085 | |
| Test on ice-stalagmite | | | | | | | |
| 1 | 6.92 m | 2.15 s | 0.0064 | 7.03 m | 2.11 s | 0.0065 | Mean friction |

TABLE 1-continued

| | Traveling direction | | | Reverse traveling direction | | | |
|---|---|---|---|---|---|---|---|
| Times | Gliding stop distance | Passing time | Friction coeffi-cient | Gliding stop distance | Passing time | Friction coeffi-cient | Test results |
| 2 | 7.23 m | 2.10 s | 0.0064 | 6.82 m | 2.01 s | 0.0074 | coefficient |
| 3 | 7.36 m | 2.16 s | 0.0059 | 6.94 m | 2.10 s | 0.0067 | 0.0064 |
| 4 | 6.35 m | 2.16 s | 0.0069 | 6.72 m | 2.28 s | 0.0058 | |
| 5 | 6.77 m | 2.32 s | 0.0056 | 7.20 m | 2.00 s | 0.0070 | |
| Mean | | | 0.0062 | | | 0.0067 | |

As shown above, the friction coefficient was reduced by 22%.

$$(0.0064/0.0082)=0.78$$

A famous coach was asked to carry out test runs.

In the test runs, the difference of traveling efficiency on conventional general ice and artificial ice-stalagmite rinks was evaluated from the technical viewpoint of the coach.

(Evaluation)

High speed feeling was able to be evidently experienced.

Repulsion and spring were felt, and the force kicked by feet did not disappear.

There was the similar tremor feeling as we frequently feel the moment we get on an escalator when I entered from the general ice surface to the artificial ice-stalagmite rink.

Because this invention is a single crystal manufacturing method for manufacturing a single crystal substance by creating a temperature environment in which the top section of the refrigerating temperature distribution of a hermetically sealed refrigerating space is held to high temperature and the bottom section to low temperature and dropping the liquid substance from the high-temperature section to the low-temperature section as described above, a single crystal substance can be provided.

Because this invention is a single crystal ice manufacturing method for manufacturing single crystal ice by creating a temperature environment in which the top section of the refrigerating temperature distribution of a hermetically sealed refrigerating space is held to high temperature and the bottom section to low temperature, guiding water to the high-temperature section, and dropping the water to the low-temperature section.

In addition, this invention can allow the single crystal to grow by supplying water to seed ice of single crystal ice cut at the plane crossing with the crystal orientation of the single crystal ice at right angles.

Furthermore, this invention can manufacture single crystal ice because cooling pipes are arranged at the bottom section in the hermetically sealed refrigerating space with the inner surface covered with heat insulating material, a water conducting tube is arranged at the top section of the hermetically sealed refrigerating space, the dripping apparatus is connected to the water conducting tube, a temperature environment in which the top section of the refrigerating temperature distribution is held to high temperature and the bottom section to low temperature is created in the hermetically sealed refrigerating space, water is dropped from the dripping apparatus, and single crystal ice is made at the bottom section.

This invention can provide a skate-rink with less friction resistance or larger friction resistance because it can provide a skate-rink ice-making technique using single crystal ice with the crystal orientations directed to the intended direction.

In addition to the above, because this invention is "single crystal ice," "transparency", "difficult to thaw", and "bendable ice" which are characteristics of ice-stalagmites of this invention, this invention can be applied to rocked ice used for drinking whisky on the rocks, the use as ice-making art (manufacture of engraved ice and ice-pillar flower), colored ice, nourishing ice with vitamins added, dish-formed ice for perishable foods, etc.

What is claimed is:

1. A single crystal manufacturing method for manufacturing a single crystal substance comprising the steps of:

creating a temperature environment in which a top section of a refrigerating temperature distribution of a hermetically sealed refrigerating space is held to a high temperature and a bottom section to a low temperature; and dripping droplets of a liquid substance from the high-temperature section to the low-temperature section.

2. A single crystal ice manufacturing method for manufacturing single crystal ice comprising the steps of:

creating a temperature environment in which a top section of a refrigerating temperature distribution of a hermetically sealed refrigerating space is held to a high temperature and a bottom section to a low temperature;

guiding water to the high-temperature section; and dripping droplets of the water from the high-temperature section to the low-temperature section.

* * * * *